US006823651B2

(12) United States Patent
Thierjung et al.

(10) Patent No.: US 6,823,651 B2
(45) Date of Patent: Nov. 30, 2004

(54) RAISED SEAL SURFACE FOR CONTAINER

(75) Inventors: George A. Thierjung, Neenah, WI (US); James R. Lamb, Greenville, WI (US)

(73) Assignee: Pechiney Emballage Flexible Europe (FR)

( * ) Notice: Subject to any disclaimer, the term of this patent is extended or adjusted under 35 U.S.C. 154(b) by 0 days.

(21) Appl. No.: 10/394,626

(22) Filed: Mar. 21, 2003

(65) Prior Publication Data

US 2004/0182047 A1 Sep. 23, 2004

(51) Int. Cl.[7] ..... B65B 7/28; B65B 61/00; B65D 53/02; B65D 53/04

(52) U.S. Cl. ..... 53/421; 53/129.1; 53/490; 215/349; 215/350; 215/352

(58) Field of Search ..... 53/421, 129.1, 53/490, 331.5, 317; 215/349, 350, 352, 276, 44, 45

(56) References Cited

U.S. PATENT DOCUMENTS 111,607 A * 2/1871 Bissell ..... 215/276
2,686,606 A * 8/1954 Froitzheim ..... 215/350
4,425,410 A * 1/1984 Farrell et al. ..... 428/516
5,341,949 A * 8/1994 Hayes ..... 215/253
5,455,180 A * 10/1995 Reid ..... 215/350
5,664,694 A * 9/1997 Bietzer et al. ..... 215/256
5,992,658 A * 11/1999 Berger ..... 215/232
6,006,937 A * 12/1999 Baravaglio et al. ..... 220/62.18

OTHER PUBLICATIONS

Physical Sample of Container.

* cited by examiner

*Primary Examiner*—Stephen F. Gerrity
(74) *Attorney, Agent, or Firm*—McDermott Will & Emery LLP

(57) ABSTRACT

A thermoplastic retort container for receiving a closure having a compressible gasket. The present invention further includes a sealing system for sealing the finish of a thermoplastic retort container. The sealing system includes a finish configured to engage a compressible gasket within a closure. Moreover, the present invention includes a method of sealing a container using a closure having a compressible gasket, wherein the container has a land portion for engaging the compressible gasket.

19 Claims, 5 Drawing Sheets

RAISED SEAL SURFACE FOR CONTAINER

FIELD OF THE INVENTION

The present invention relates generally to a sealing system for a container. More specifically, the present invention relates to sealing system for a container and a closure having a lining seal. The sealing system has been found to be beneficial for use with, among others, retort containers.

BACKGROUND OF THE INVENTION

Many food products have long been delivered to customers in sealed plastic containers. In many instances sealed containers containing food products were subjected to thermal processing. For example, it is known to subject such products to a retort process to stabilize and preserve the food product by killing undesirable organisms therein. Retort was a process by which a sealed container was subjected to a system by which the internal product was heated in a pressurized environment for an extended period of time. Typically, the container and its contents were heated to a predetermined temperature, thereby increasing the internal pressure. Then the container and its contents were then maintained at the predetermined elevated temperature and pressure for a period of time sufficient to kill the undesirable organisms therein. Finally, the container and its contents were cooled and the internal pressure was decreased to ambient levels. The increased pressure and temperature experienced by the container during retort resulted in increased internal forces that adversely affected the container's seal.

It was known to use a gasket liner to seal a container that was to be subjected to a retort process. A gasket liner seal utilized a thin flexible polymer gasket held against the finish of the container under compression forces generated by the closure. The effectiveness of the gasket liner was dependent on the position of the closure with respect to the finish of the container. Differential shrinkage rates between the thermoplastic materials forming the closure and the container, combined with increased differential pressure (i.e., internal vs. external pressure), caused "back off" of the closure and the gasket liner and resulted in a less effective sealing mechanism. That is, as the closure and container experienced differential shrinkage and the pressure increased within the container, the closure was pushed away from the upper surface of the finish, lessening the compression imparted to the gasket. Failure of the sealing mechanism rendered the packaged product defective.

FIG. 1 illustrates a cross-sectional exploded view of the finish portion of a prior art container and a closure having a gasket that was used to package products to be retorted. FIG. 1 is an example of a container having a reamed finish for interacting with a compressible gasket. The internal diameter of this finish configuration of the container was reamed to reduce the cross-sectional area of the portion of the container's finish that would contact the gasket. The reduced cross-sectional area produced an increased pressure on the gasket and caused it to sink deeper into the seal. Reamed containers were problematic for sealing retort containers. For example, reamed containers required multiple stages of processing before being made suitable for packaging products. First the containers were molded, then the molded containers were trimmed to remove excess material, the containers were then reamed to reduce the thickness of the finish, and finally the containers were cleaned to remove chips of plastic from the container that resulted from the reaming process. The ream requirement was therefore responsible for two manufacturing steps.

FIG. 2 demonstrates how a container having a reamed finish interacted with a closure having a compressible gasket. As shown, the reamed finish pushed against the compressible gasket to form a seal. FIG. 3 shows the container and closure during a retort, or other heat intensive process. The arrows in FIG. 3 demonstrate the forces caused by the increased internal pressure and the resulting "back-off." As shown, the increased forces pushed outwardly along the thinned finish wall and upwardly on the closure. The internal forces caused the seal between the container and the closure to be degraded. Further, the portion of the finish that was reamed was weakened by the removal of material and the internal pressure could deform the weakened finish causing further degradation of the seal.

SUMMARY OF THE INVENTION

The present invention provides a seal system for a container and a closure having a compressible gasket. The finish of the container is configured to compress the gasket to provide an effective compression seal and reduce oxygen permeation rate of the container. The finish has a raised seal surface, such as, for example, an angled land portion, configured to dig into the compressible gasket. The compressible gasket wraps around the point of contact providing the effective compression seal. The closure system of the present invention is particularly advantageous for use with containers to be subjected to retort or other thermal processing.

It is one of the principal objectives of the present invention to provide a sealing system for a retort container.

It is another objective of the present invention to provide a container configured to engage a compressible gasket to form a compression seal.

It is a further objective of the present invention to provide a sealing system that allows for an effective compression seal to be formed along the finish of a retort container sealed using ANSI recommended torque parameters.

It is yet another objective of the present invention to provide a scaling system for a container that maintains the integrity of the seal despite closure back-off.

It is still another objective of the present invention to provide a container for retort that does not requiring a reaming process.

These and other objectives of the present invention will become apparent upon examining the drawings and figures together with the accompanying written description thereof.

DETAILED DESCRIPTION OF THE DRAWINGS

Figure 1:
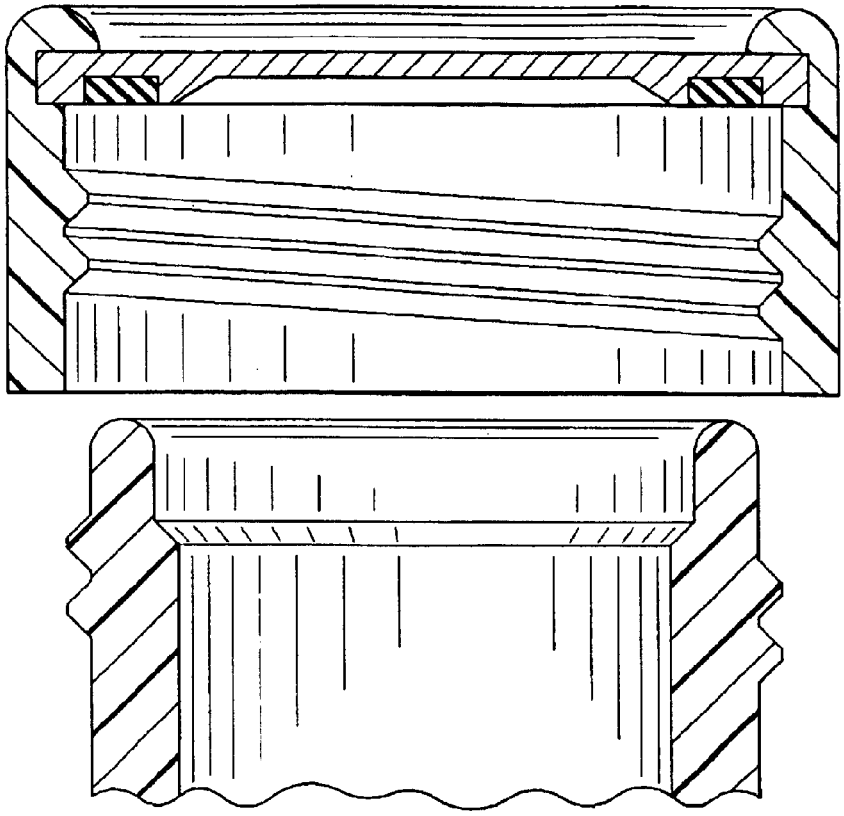
FIG.1 PRIOR ART
FIG. 1 is a cross-sectional view of a reamed container and a threaded closure.
Figure 2:
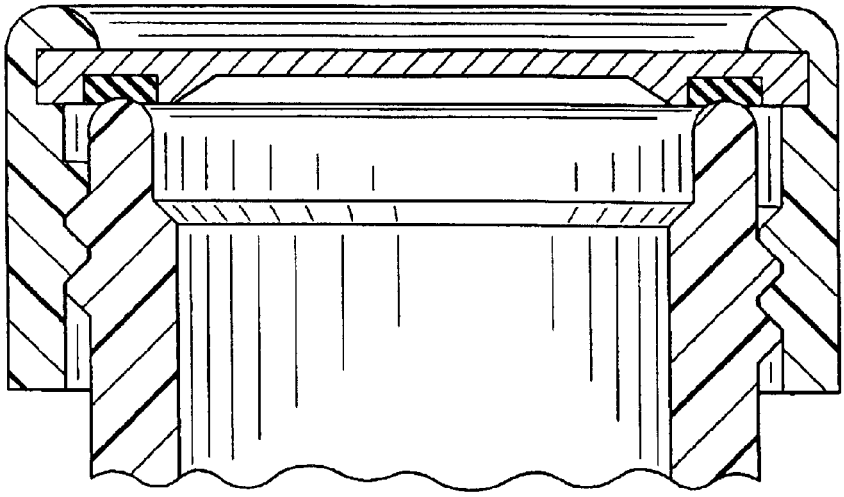
FIG.2 PRIOR ART
FIG. 2 is a cross-sectional view of the container and threaded closure of FIG. 1, wherein the container is sealed.
Figure 3:
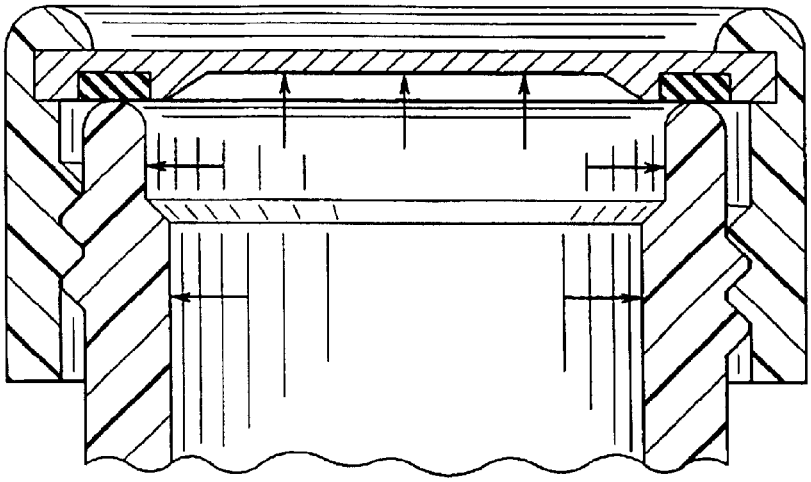
FIG.3 PRIOR ART
FIG. 3 is a cross-sectional view of the container and threaded closure of FIG. 1, wherein internal pressure causes seal degradation.
Figure 4:
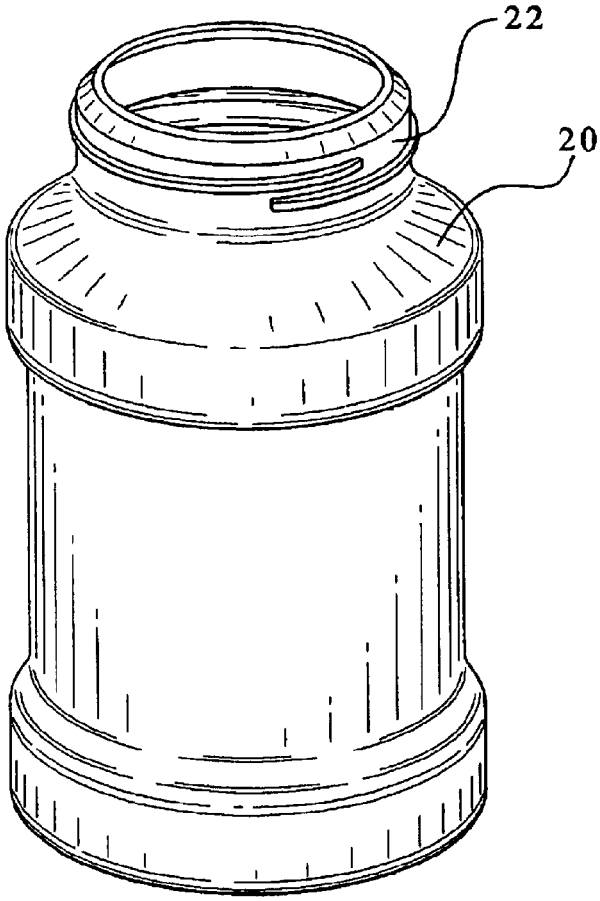
FIG. 4 is a perspective view of a container of the present invention.

The present invention relates to a sealing system for a container. As shown in FIG. 4, the sealing system includes a container 20 having a finish 22 configured to engage a closure having a compressible gasket liner 44 (see FIG. 7). The container 20 may be constructed from polypropylene (PP), polyethylene terephthalate (PET) or any other polymeric material, multi-layer polymeric composite, or blend of polymeric materials. The container 20 may be formed via extrusion blow molding, injection blow molding or in any other manner. For example, it is contemplated that the container 20 may comprise the construction disclosed in U.S. Pat. No. 4,425,410 to Farrell, the entirety of which is incorporated herein by reference. The structure disclosed in U.S. Pat. No. 4,425,410 is particularly applicable to a container 20 to be subjected to retort.

In one embodiment, the container 20 is provided for packaging food materials. More particularly, the container 20 is provided for packaging food materials that require being subjected to thermal processing, such as, for example, a retort process, prior to commercial distribution. The sealing system is provided to maintain a reliable seal throughout processing, and distribution consistent with the objectives of the present invention. Other applications of the sealing system of the present invention are also contemplated.

Figure 5:
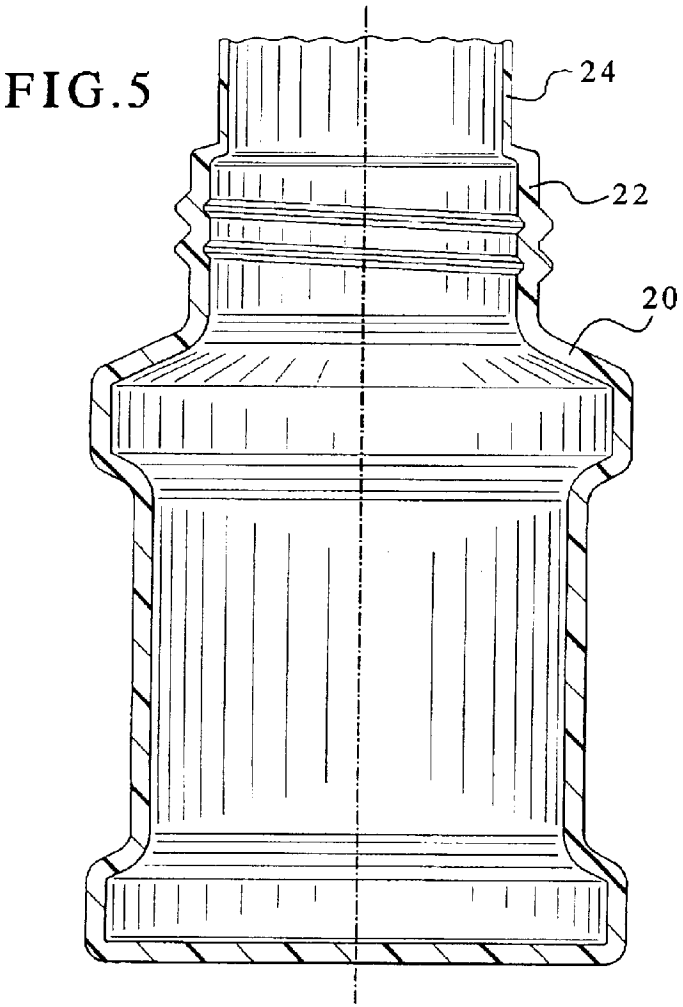
FIG. 5 is a cross-sectional view of a container of the present invention prior to being subjected to a spin trim process.

FIG. 5 illustrates the container 20 and finish 22 having a moil 24 left by, for example, an extrusion blow molding manufacturing process. Prior to utilizing the container 20 for packaging purposes, the moil 24 may be removed from the container 20 via a spin trimming process, as known in the art of extrusion blow molding. One contemplated embodiment of the present invention is formed by spin trimming the container 20 shown in FIG. 5 using a heated knife to remove the moil 24 and forming the container 20 and finish 22 shown in FIG. 6.

Figure 6:
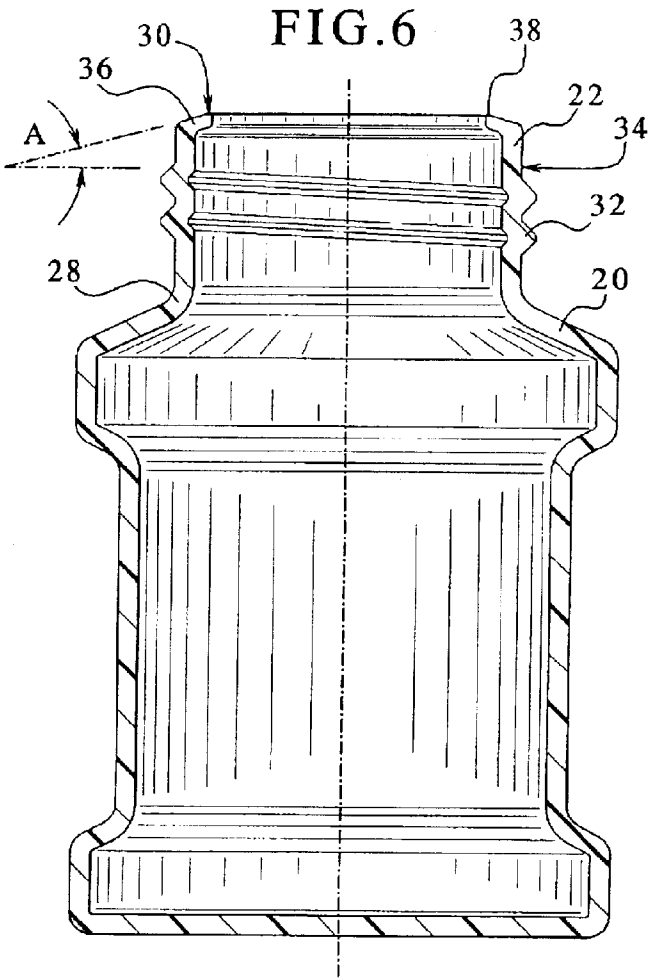
FIG. 6 is a cross-sectional view of the container of FIG. 5 after being subjected to a spin trim process of the present invention.
Figure 7:
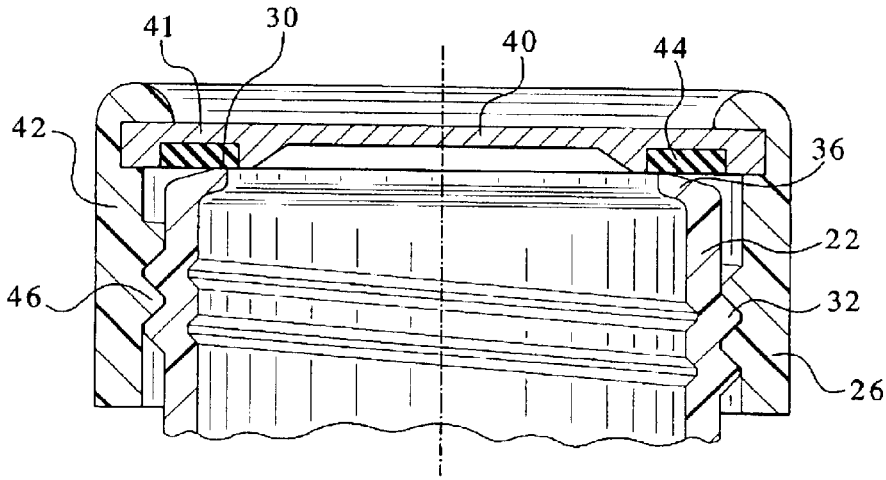
FIG. 7 is a cross-sectional view of the finish of a container of the present invention and a combination (metal-plastic) closure having a plastisol gasket.

FIG. 7 depicts a cross-sectional view of the finish 22 of the container 20 shown in FIG. 6 and a threaded closure 26 partially seated on the finish 22. Although the embodiments shown in FIGS. 5-10 incorporate threaded closures 26, the present invention is applicable to other closures utilizing a compressible gasket, as described further below, with the threaded finish 22 or without the depicted threads. As shown in FIG. 6, the finish 22 of the container 20 extends from a shoulder area 28 to an upper sealing surface 30. One or more finish threads 32 project from an exterior 34 of the finish 22 that is oriented parallel with the longitudinal axis of the container. Above the finish threads 32 the finish 22 extends parallel to the longitudinal axis to a land portion 36.

The land portion 36 shown in FIG. 6 extends towards the interior of the container 20 at an angle A from the horizontal (i.e., perpendicular to the longitudinal axis). In the embodiment depicted in FIG. 6, angle A is approximately fifteen degree. However, angle A may be other angles as described further below. The land portion 36 shown in FIG. 6 includes a flat surface 38 formed along the upper sealing surface 30. If the container is formed by an extrusion blow molding process, the flat surface 38 is formed from contact with the heated knife during the spin trimming process. It is recognized that the appropriate angle of the land portion 36 will vary based on the materials, internal pressures, gasket material and configuration and the other configurations used in the container 20 and the threaded closure 26 as described further below.

The land portion 36 of the container 20 shown in FIG. 6 is formed during the molding process. It is recognized that the land portion 36 may be formed using a mold incorporating a land portion 36 in an injection or extrusion blow molding process. Alternatively, the land portion 36 may be formed form a separate piece of material secured to the finish 22 or in any other manner for forming a thermoplastic structure.

As shown in FIG. 7, the closure 26 comprises a top 40 having a gasket liner channel 41, a skirt 42 and a compressible gasket 44. In the depicted embodiment the skirt 42 comprises one or more closure threads 46 protruding from the interior of the skirt 42. The closure threads 46 correspond in configuration to the finish threads 30 in a manner allowing engagement between the finish 22 and the threaded closure 26. As further shown, the threaded closure 26 illustrated in FIG. 7 is a combination closure, e.g., the skirt 42 is formed from plastic and the top 40 is formed from metal. The threaded closure 26 shown in FIG. 7 utilizes a metal top 40 for reduced oxygen permeability and increased thermodynamic properties and plastic skirt 42 with closure threads 46 for shrinkage compatibility and to provide a better fit with the plastic finish threads 30. Alternatively, the threaded closure 26 may be formed from any number of materials or a single material (e.g., plastic) with a gasket.

The compressible gasket 44 shown in FIG. 7 is a plastisol liner. However, the compressible gasket 44 may be formed from any compressible material suitable for forming a seal against the finish 22 as would be appreciated by one with ordinary skill in the art. The compressible gasket 44 should be of sufficient thickness and resiliency to allow the compressible gasket 44 to form a seal along the upper sealing surface 30 of the container as described further with respect to FIG. 8. The compressible gasket 44 should also be of sufficient thickness and resiliency to compensate for, and conform to, the various irregularities and discontinuities normally experienced with the upper sealing surface 30 of the container 20 to which the threaded closure 26 will be applied. The thickness and resiliency of the land portion 36 should also take into consideration the expected "back off," as described below. The thickness and resiliency of the compressible gasket 44 necessary to achieve the objectives of the present invention can be determined by one of ordinary skill in the art without undue experimentation.

The configuration of the land portion 36 will vary based on the material used to form the land portion 36, the cross-section of the land portion 36, the material used to form the land portion 36, the width of the gasket liner channel 41, the material used to form the compressible gasket 44, the thickness of material used to form the compressible gasket 44, the closure torque applied to the threaded closure 26 and other variables as described further below. Moreover, it is recognized that with respect to the embodiment shown in FIG. 7, the land portion 36 may he angled between a range of approximately 10 and 25 degrees to effectively accomplish the objectives of the invention as described herein.

In the attached drawings, FIGS. 5-10, the thickness of the land portion 36 is approximately the same as the rest of the container 20. Alternatively, the land portion 36 may be thicker or thinner that the remainder of the container 20. However, it is recognized that as the overall size of the container 20 increases, it may be beneficial for the thickness of the land portion 36 to increase as well. Moreover, the thickness of the land portion 36 may vary over the length of the land portion 36, such as, for example, the land portion 36 may be tapered to allow the land portion 36 to more easily dig into the compressible gasket 44 as the threaded closure 26 is applied, as discussed further below. The land portion 36 may further include additional features, such as, for example, ribs for providing additional surfaces for interaction with the compressible gasket 44.

Figure 8:
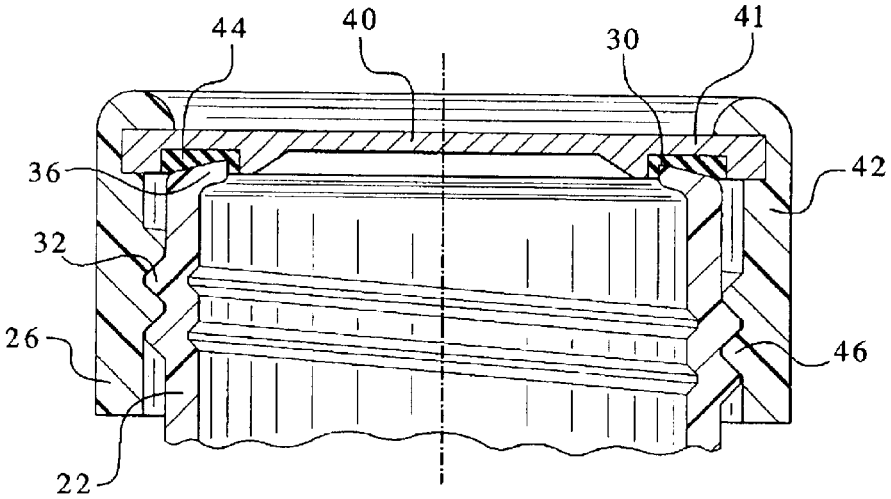
FIG. 8 is a cross-sectional view of the container and closure of FIG. 7, wherein the container is sealed.

FIG. 8 illustrates the container 20 and threaded closure 26 shown in FIG. 7 after the threaded closure 26 has been fully applied to the finish 22. As the threaded closure 26 is tightened onto the finish 22, the land portion 36 engages and compresses the compressible gasket 44 to form a seal along the land portion 36 of the upper sealing surface 30 of the finish 22. Compression of the compressible gasket 44 decreases the oxygen permeation rate through the compressible gasket 44 by increasing the density of the material used to form the compressible gasket 44 thereby creating a more torturous path for gas permeation. Accordingly, the oxygen permeation rate of the compressible gasket 44 directly correlates to the amount of compression experienced by the compressible gasket 44.

As shown in FIG. 8, as the threaded closure 26 is applied to the finish 22, the angled land portion 36 digs into the compressible gasket 44 and the compressible gasket 44 wraps around the land portion 36 forming a seal. Because the land portion 36 does not fill the width of the gasket liner channel 41, the compressible gasket 44 experiences uneven compressive force along its radial width. The land portion 36 configuration shown in FIG. 8 is particularly beneficial when using a compressible gasket 44 formed from a plastisol material because plastisol has a tendency to relax when a constant pressure is applied across the width of the compressible gasket 44. Plastisol does not exhibit the same tendency to relax when a compressive force is applied unevenly across the radial width of the compressible gasket 44. Moreover, the configuration of the land portion 36 shown in FIG. 8 allows the plastisol compressible gasket 44 wrap around the land portion 36, thereby further securing the seal between the land portion 36 and the compressible gasket 44. Such wrapping would not occur if the land portion 36 was as wide as the gasket liner channel 41 because the compressible gasket 44 will not wrap around a flat surface that applies force evenly across the radial width of the compressible gasket 44.

Once the threaded closure 26 is in place on the container 20, the container 20 may be subjected to a heat intensive process. For example, the container 20 shown in FIG. 8 may be subjected to a retort process wherein the sealed container 20 and its contents may be typically be heated to approximately 210–272 degrees Fahrenheit over 5–45 minutes, held at the raised temperature for as long as 90 minutes while the internal pressure of the retort vessel is increased as high as approximately 45–50 psi, and then cooled over 10–30 minutes as the temperature and internal pressure are reduced to ambient levels.

Figure 9:
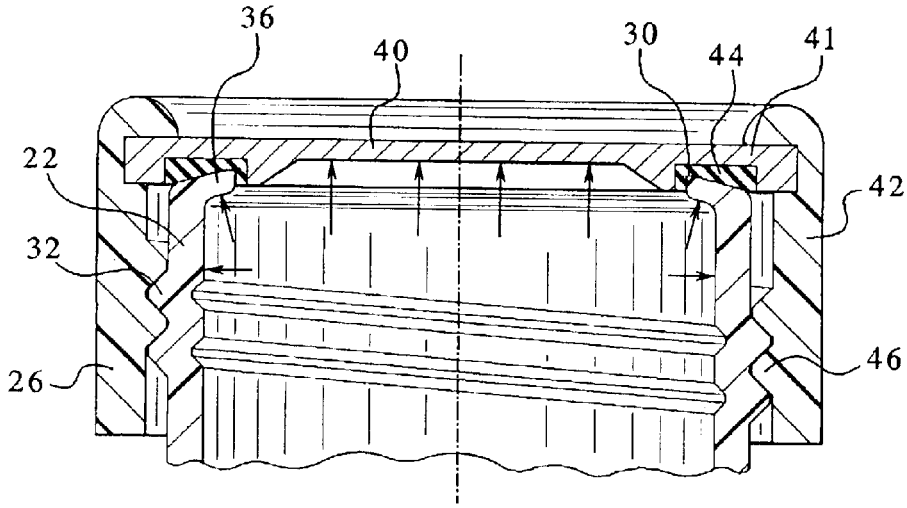
FIG. 9 is a cross-sectional view of the container and closure of FIG. 7, wherein the container is sealed and subjected to inner pressure.

FIG. 9 illustrates the container 20 and threaded closure 26 of FIG. 8 while the container 20 is being subjected to a heat intensive process, such as the retort process described above. As the container 20, the threaded closure 26 and the contents of the container (not shown) are heated and the container's internal pressure is increased, forces are applied to the internal surfaces of the container 20 and the threaded closure 26. The arrows depicted in FIG. 9 illustrate the forces applied to the container 20 and threaded closure 26 due to the increased internal pressure. As shown in FIG. 9, the applied forces push along the interior surfaces of the container 20 and threaded closure 26 perpendicular to each respective surface. As shown, forces are exerted along the finish 22, including the land portion 36, as well as the top 40 of the threaded closure 26.

The container 20 and threaded closure 26 of the present invention maintain an effective seal along the upper scaling surface 30 of the finish 22 throughout a heat intensive process, as well as before and after such process. As shown in FIG. 9, as the difference between the container's 20 internal and external pressure increases, a force is exerted against the top 40 of the threaded closure 26 tending to push the top 40 away from the finish 22. However, as the top 40 is being pushed away from the finish 22, the internal pressure also exerts a force against the land portion 36, pushing the land portion 36 into the compressible gasket 44, thereby maintaining an effective seal along the upper sealing surface 30 of the finish 22, even as the top 40 is pushed upwards by the increasing internal pressure.

Further as shown in FIG. 9, the heat intensive process may cause the thermoplastic container 20 to shrink. As will be recognized by one of ordinary skill in the art, this shrinkage may cause the threaded closure 26 to "back off" from the finish 22. "Back off" occurs when the distance between the finish threads 32 and the upper sealing surface 30 shrinks. However, as discussed above with respect to FIG. 9, the forces caused by the increasing internal pressure force the land portion 36 into the compressible gasket 44, compensating for any "back off" and maintaining an effective seal.

Figure 10:
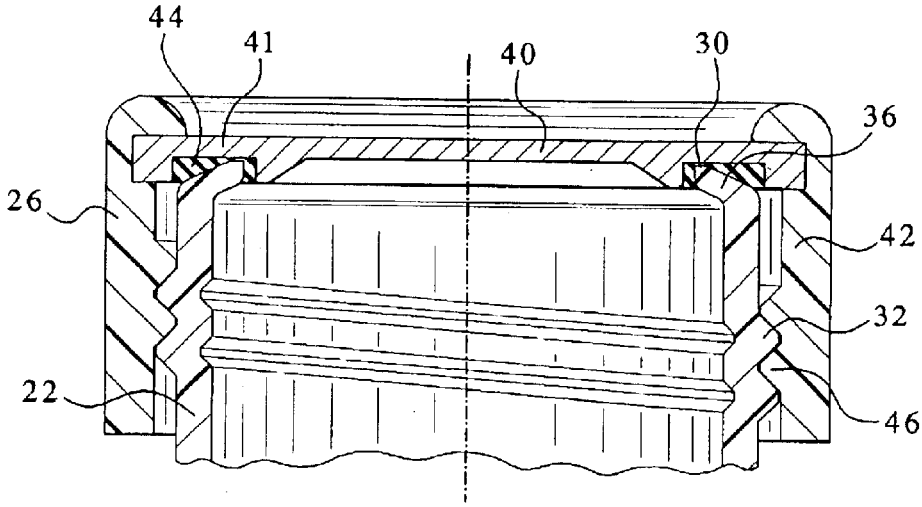
FIG. 10 is a cross-sectional view of another container and closure of the present invention, wherein the container is sealed.

FIG. 10 illustrates an alternative embodiment of the present invention wherein the land portion 36 is provided at an angle of approximately twenty-five degrees from the horizontal (i.e., perpendicular to the longitudinal axis). As shown in FIG. 10, the land portion 36 engages and compresses the compressible gasket 44 to form a seal along the upper sealing surface 30 of the finish 22. Although the width of the gasket liner channel 41 and the compressible gasket 44 are shown as a constant width between FIGS. 7-10, it is contemplated that it may be advantageous to increase the angle of the land portion 36 when using a narrower and/or deeper compressible gasket 44.

In one embodiment, the compressible gasket 44 may be compressed between approximately ten to twenty-five thousandths of an inch.

It should be noted that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A container for receiving a closure having a compressible gasket comprising:

a finish for receiving the closure; and a resilient land portion including a proximal end attached to said finish and a distal end extending inward from the outer diameter of said finish for interacting with the compressible gasket, wherein internal pressure within the container exerts a force against said resilient land portion, pushing at least said distal end of said resilient land portion into the compressible gasket.

2. The container of claim 1 wherein said resilient land portion extends from said finish at an angle of approximately fifteen degrees from perpendicular.

3. The container of claim 1 wherein said resilient land portion extends from said finish at an angle between approximately ten to twenty-five degrees from perpendicular.

4. The container of claim 1 wherein said resilient land portion is tapered.

5. The container of claim 1 wherein said resilient land portion is formed via extrusion blow molding.

6. A sealing system for a container comprising:

a finish;

a resilient land portion including a proximal end attached to said finish and a distal end extending inward from said finish;

a compressible gasket adjacent to said resilient land portion; and a closure for engaging said finish and compressing said compressible gasket against said resilient land portion wherein internal pressure within the container exerts a force against said resilient land portion, pushing at least said distal end of said resilient land portion into said compressible gasket.

7. The sealing system of claim 6 wherein said resilient land portion extends from said finish at an angle of approximately fifteen degrees from perpendicular.

8. The sealing system of claim 6 wherein said resilient land portion extends from said finish at an angle between approximately ten to twenty-five degrees from perpendicular.

9. The sealing system of claim 6 wherein said resilient land portion is tapered.

10. The sealing system of claim 6 wherein said resilient land portion is formed via extrusion blow molding.

11. The sealing system of claim 6 wherein said closure is a threaded closure.

12. The sealing system of claim 6 wherein said closure includes a gasket liner channel.

13. The sealing system of claim 6 wherein said compressible gasket is formed from a plastisol material.

14. A method of sealing a container comprising:

providing a container having a finish and a resilient land portion including a proximal end attached to said finish and a distal end extending inward from said finish;

providing a closure having a compressible gasket; and engaging said closure to said finish such that said closure holds said compressible gasket against said resilient land portion, wherein internal pressure within the container exerts a force against said resilient land portion pushing at least said distal end of said resilient land portion into said compressible gasket.

15. The method of claim 14 wherein said compressible gasket is compressed between approximately ten to twenty-five thousandths of an inch.

16. The method of claim 14 wherein engaging said closure to said finish further includes engaging said closure to said finish using approximately twenty to forty-five inch-pounds of torque.

17. The method of claim 14 wherein said resilient land portion extends from said finish at an angle of approximately fifteen degrees from perpendicular.

18. The method of claim 14 wherein said compressible gasket is formed from plastisol.

19. The method of claim 14 wherein said closure is a threaded closure.

* * * * *